US009581928B2

(12) United States Patent
Deno

(10) Patent No.: US 9,581,928 B2
(45) Date of Patent: Feb. 28, 2017

(54) IMAGE FORMING APPARATUS

(71) Applicant: CANON KABUSHIKI KAISHA, Tokyo (JP)

(72) Inventor: Kohei Deno, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/713,378

(22) Filed: May 15, 2015

(65) Prior Publication Data

US 2015/0338813 A1 Nov. 26, 2015

(30) Foreign Application Priority Data

May 23, 2014 (JP) ..... 2014-107515

(51) Int. Cl.
*G03G 15/00* (2006.01)
*B65H 7/10* (2006.01)
*G03G 15/043* (2006.01)

(52) U.S. Cl.
CPC ..... *G03G 15/043* (2013.01); *G03G 15/6561* (2013.01); *G03G 15/6567* (2013.01); *B65H 7/10* (2013.01); *B65H 2404/142* (2013.01); *B65H 2404/1422* (2013.01); *B65H 2404/1424* (2013.01); *B65H 2404/152* (2013.01); *G03G 2215/00405* (2013.01); *G03G 2215/00561* (2013.01); *G03G 2215/00721* (2013.01)

(58) Field of Classification Search
CPC ..... B65H 2404/1424; B65H 2404/142; B65H 2404/1422; B65H 2404/152; B65H 7/10; G03G 15/6561; G03G 2215/00405
See application file for complete search history.

(56) References Cited

U.S. PATENT DOCUMENTS 8,032,041 B2 10/2011 Atsumi et al.
8,348,266 B2 1/2013 Deno
8,540,240 B2 9/2013 Deno et al.
2008/0054555 A1 3/2008 Atsumi et al.
(Continued)

FOREIGN PATENT DOCUMENTS

EP 1882594 A1 1/2008

OTHER PUBLICATIONS

European Office Action issued in corresponding European Application No. 15168589.8 dated Oct. 14, 2015.

*Primary Examiner* — Robert Huber
*Assistant Examiner* — John M Royston
(74) *Attorney, Agent, or Firm* — Fitzpatrick, Cella, Harper & Scinto

(57) ABSTRACT

According to the present disclosure, an image forming apparatus for minimizing a shift amount of the registration roller for the first and subsequent sheets is provided. The image forming apparatus forms an image on a sheet conveyed on a conveying path. The image forming apparatus includes an exposure device. Further, the image forming apparatus includes a pair of registration rollers 110 configured to convey the sheet in a conveying direction with the sheet nipped by the pair of the registration rollers, and a detection unit configured to detect the side edge position in the width direction of the sheet conveyed. The control unit 200 of the image forming apparatus determines the image writing position for the first sheet, and controls the image writing of the exposure device based on the detection result of the CIS 141 for the first sheet.

10 Claims, 12 Drawing Sheets

(56) References Cited

U.S. PATENT DOCUMENTS

| | | | | |
|---|---|---|---|---|
| 2009/0154975 | A1* | 6/2009 | Ogata et al. | 399/388 |
| 2012/0025457 | A1* | 2/2012 | Inoue | 271/227 |
| 2012/0141179 | A1 | 6/2012 | Atsumi | |
| 2013/0114096 | A1 | 5/2013 | Yamashita | |
| 2014/0016950 | A1* | 1/2014 | Hitaka | 399/16 |
| 2014/0050494 | A1 | 2/2014 | Kawanago | |
| 2015/0097333 | A1* | 4/2015 | Kimura et al. | 271/227 |

* cited by examiner

IMAGE FORMING APPARATUS

BACKGROUND OF THE INVENTION

Field of the Invention

The present disclosure relates to an image forming apparatus which forms an image on a sheet.

Description of the Related Art

Conventionally, some image forming apparatuses which form an image on a sheet include a mechanism for aligning a position of a sheet with an image to be written on the sheet. In this mechanism, for example, the sheet is shifted in a direction (a width direction of the sheet) which is perpendicular to a sheet conveying direction, thereby correcting the sheet position. Thus, there are image forming apparatuses which include a sheet conveyance device having a mechanism for correcting the posture (skew) and the position of the sheet to be conveyed to an image forming unit. Further, with the tendency to improve productivity of an image forming apparatus in recent years, a period allowed for a shift action by the registration roller for a sheet position correction and that allowed for the process of a return operation after a shift etc., to spend becomes short. Therefore, when a position deviation of the sheet conveyed toward the image forming unit is large, the amount the shift action for correcting the same also becomes large. Therefore, it may not possible to complete the return operation within a predetermined period in some cases.

Further, it is desirable to minimize the shift amount at the time of correcting the position deviation. For example, as the shift amount of the registration roller becomes large, "twist" may arise in the sheet. As a result, the conveying direction of the sheet may be inclined, or shift accuracy may be deteriorated. It is desirable to minimize the shift amount of the sheet, also from this point of a view. In addition, as the miniaturization of an apparatus, there is a tendency to decrease the distance between the registration roller which has a shift mechanism and the conveyance roller positioned at the upstream thereof (i.e., the upstream in the conveying direction). And, upon shift action by the registration roller, for all the conveyance rollers except for the registration roller, it is necessary to cancel nipping of the sheet by the conveyance rollers. Therefore, it may disturb the minimization of an apparatus, and may increase the cost due to a complicated configuration of the apparatus.

Under these circumstances, US2009/0154975 (A1) describes an image forming apparatus which employs a control method in which, based on the detection result of a certain sheet in a width direction, an image forming position of a sheet, which is conveyed after a predetermined pages, is determined for decreasing the shift amount. Specifically, the mechanism provided in the apparatus corrects the inclined tip portion of the sheet by moving the tip of the sheet conveyed by the pre-registration roller to contact with the nip portion of the registration controller, which is provided upstream of the registration roller, to curl the sheet. Further, the apparatus includes a width direction correcting mechanism which corrects the position in a direction which is perpendicular to the conveying direction of the sheet (i.e., width direction of the sheet). This width direction correcting mechanism includes a width direction detection unit configured to detect a position in a sheet width direction provided downstream of the registration roller, and shift unit configured to shift the registration roller in the sheet width direction with nipping the sheet.

In recent years, an intermediate transfer tandem type in which image forming units each corresponding to one of four colors are arranged on an intermediate transfer belt is mainly used, due to its advantageous adaptability for a variety of sheets and advantageous print productivity. However, especially in the color image formation, a peripheral length of an intermediate transfer belt is relatively long, therefore, it takes relatively long time from a completion of forming an image of first color to an arrival of the image to a secondary transfer section.

On the other hand, US2009/0154975 (A1) describes an image forming apparatus in which a sheet width direction detection unit is arranged downstream of a registration roller. Therefore, the time from detecting a sheet end to a conveyance of the sheet to a secondary transfer section is less than the time for the arrival of the image to a secondary transfer section describe above.

Thus, in this image forming apparatus, as to each of the first sheet and the second sheet, the correction amount of the image formation position is decided to be zero, while the deviation amount of the position of the sheet end itself is used as the amount to be shifted by the registration roller. As above, there remains a problem that the shift amount of the registration roller becomes large in the first sheet, for example.

The present invention is directed to solve these problems in the prior art, and is mainly directed to an image forming apparatus which can minimize, from the first sheet as well as following sheets, the shift amount by the registration roller. Particularly, the present invention provides an image forming apparatus for minimizing the shift amount even in a configuration in which the conveyance distance of the sheet in an image process becomes relatively long, for example, in an intermediate transfer tandem type.

SUMMARY OF THE INVENTION

An image forming apparatus for forming an image on a sheet conveyed on a conveying path according to the present disclosure includes: a unit configured to expose an image carrier to write the image on the image carrier; a pair of rollers configured to convey the sheet with the sheet nipped by the pair of the rollers and to shift the sheet conveyed to a width direction which is perpendicular to the conveying direction of the sheet; a detection unit configured to detect the sheet conveyed to detect the side edge position in the width direction; and a control unit. It is noted that the control unit is further configured to: detect an image writing position by the exposure unit for the first sheet in a main scanning direction which is perpendicular to a moving direction of the image carrier, based on the detection result of a first sheet by the detection unit, determine a shift amount of the pair of the rollers for a second sheet, based on the image writing position determined for the first sheet and a detection result of the detection unit for a second sheet which follows the first sheet; and, control a shift operation of the pair of the rollers.

Further features of the present invention will become apparent from the following description of exemplary embodiments (with reference to the attached drawings).

DESCRIPTION OF THE EMBODIMENTS

Now, embodiments are described with reference to the accompanying drawings.

First Embodiment

Figure 1:
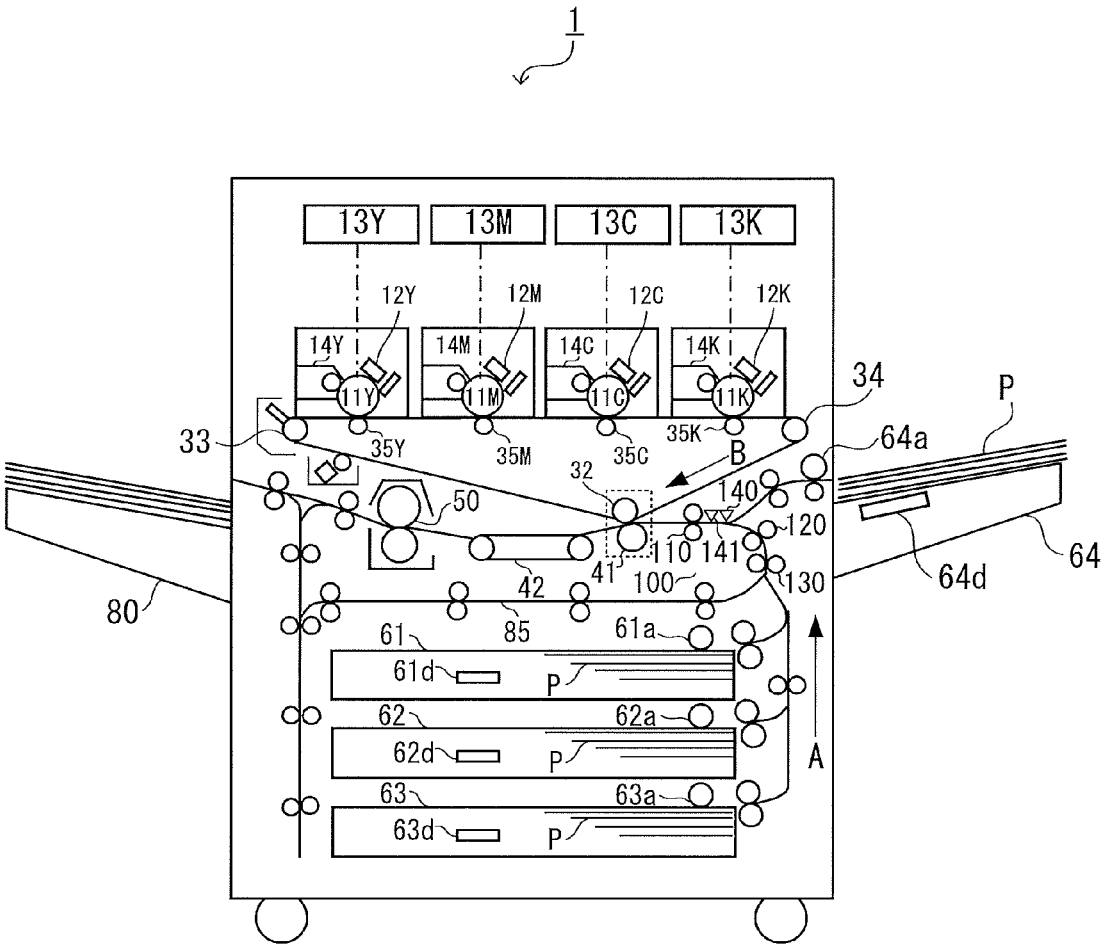
FIG. 1 is a schematic vertical cross-sectional view of an image forming apparatus according to a first embodiment.

FIG. 1 is a schematic longitudinal sectional view of an image forming apparatus according to the present embodiment. The image forming apparatus 1 illustrated in FIG. 1 is a color image forming apparatus which uses an electro photography method. In recent years, an intermediate transfer tandem type in which image forming units each corresponding to one of the four colors are arranged on an intermediate transfer belt is mainly used, due to its advantageous adaptability for a variety of sheets and advantageous print productivity. Therefore, in the following description, the image forming apparatus 1 of the present embodiment having an image forming unit of an intermediate transfer tandem type is explained.

The image forming apparatus 1 illustrated in FIG. 1 includes an image forming unit, a secondary transfer unit and a sheet conveying device (sheet conveying unit). The image forming unit of the image forming apparatus 1 includes photoreceptors (image carrier) 11Y, 11M, 11C and 11K which respectively correspond to yellow(Y), magenta (M), cyan(C) and black(K), a charging device 12, an exposure device 13 which serves as an image writing unit, and a developing device 14. Further, the image forming unit includes an intermediate transfer belt 31, a secondary transfer inner roller 32, a driving roller 33, a tension roller 34, and a primary transfer device 35. In the image forming unit, the surface of the photoreceptor 11, which serves as an image carrier, is previously charged uniformly by the charging device 12, and the exposure device 13 is driven based on the signal of image information. Thereby an electrostatic latent image is formed on the surface of the rotating photoreceptor 11. The electrostatic latent image formed on the image carrier (on the surface of the photoreceptor 11) is developed as a toner image through a toner developing process by the developing device 14. Thereafter, a predetermined pressure and electrostatic load bias are applied to the toner image by a primary transfer device 35, and the toner image is then transferred to the intermediate transfer belt 31.

The intermediate transfer belt 31 is described next. The intermediate transfer belt 31 is tensioned by the drive roller 33, the tension roller 34 and the secondary transfer inner roller 32, and driven in the direction of an arrow B in FIG. 1. The image forming process of each color Y, M, C and Bk, which is processed in parallel, is performed at a timing when each color is placed on the toner image of the color having been primarily transferred at the upstream onto the intermediate transfer belt 31. As a result, full color toner images are eventually formed on the intermediate transfer belt 31. Then, the toner images are conveyed to the secondary transfer unit.

For example, sheet P, which is material to be transferred, is loaded into a sheet feeding cassette of sheet storages 61-63 or a manual sheet feeding section 64, and stored therein. The sheet P is fed from, for example, a feeding unit 61*a*, is conveyed through a conveyance roller 130 and a pair of pre-registration rollers 120 to a pair of registration rollers 110. The pair of the registration rollers 110 and the pair of the pre-registration rollers 120 corrects the inclined direction of the sheet P. Specifically, the tip of the sheet P to be conveyed is moved toward to contact with the nip portion of the pair of the registration rollers 110, which remains still. Thereby the pair of the registration rollers 110 and the pair of the pre-registration rollers 120 corrects a skew of the sheet P by curling the sheet P to form an arch portion for aligning the tip of the sheet P. Then, the pair of the registration rollers 100 conveys the sheet P to the secondary transfer unit in synchronization with the timing at which the toner images on the intermediate transfer belt 31 is transferred to the sheet P. The secondary transfer unit includes a toner image transfer nip portion formed by the secondary transfer inner roller 32 and a secondary transfer outer roller 41. Further, by applying a predetermined pressure and an electrostatic load bias, the secondary transfer unit transfers toner images to the sheet P.

The sheet P, after transferred, is conveyed by an air adsorption conveyance mechanism 42 to a fixing device 50, and after applying a pressure and heating effect, the toner image is fused and adhered to the sheet P, and the sheet P is conveyed to a discharge unit 80. In the following description, the image forming apparatus 1 of the present embodiment employs, for example, a center reference type sheet conveyance method in which the center in the direction which is perpendicular to the sheet conveying direction in the sheet conveying path and the center of the width direction of the sheet are coincident with each other.

In the sheet storage 61, 62 and 63, respective size detection mechanisms 61*d*-63*d* for detecting the size of the sheet P stored therein are provided. The size detection mechanisms 61*d* (62*d*, 63*d*) have a side regulating board (not illustrated) which regulates the position of the width direction of the sheet P and a rotatable size detection lever (not illustrated) which is in slide contact with the side regulating board. The rotatable size detection lever moves according to the side regulating board. It is noted that the side regulating board is configured such that it moves together with a side edge portion of the sheet P. Further, the size detection lever is configured such that it rotates according to the side regulating board when the side regulating board is moved together with the side edge portion of the sheet P.

In addition, the size detection mechanism 61*d* (62*d* and 63*d*) comprises two or more sensors or switches, each of which is arranged at a position corresponding to the size detection lever in a state where the sheet storage is equipped with the sheet feeding cassette. When the sheet storage is equipped with the sheet feeding cassette, the size detection lever selectively turns on/off the sensor or the detection element of the switch. Thereby, the image forming apparatus 1 receives the signal of a different pattern output from the sensor or the switch according to the sheet P stored in the sheet feeding cassette. Thus, the image forming apparatus 1 can recognize the size of the sheet P stored in the sheet feeding cassette etc., based on the received signal.

The size detection mechanisms 61*d*-63*d* detect attachment and detachment action in the sheet storages 61-63, for example, inserting/removing of the sheet feeding cassette. For example, when the sheet feeding cassette of the sheet storage has been removed, all the sensors or the detection elements have been turned off by the size detection lever. Note that the manual sheet feeding section 64 may include the size detection mechanism 64*d* and, as attachment and detachment detection mechanism, a similar mechanism.

A side regulating board is provided for preventing the skew of the sheet P generated at the time of feeding the sheet P, and for preventing the position deviation in the width direction generated at each of the conveyance rollers provided downstream of a feeding roller. However, practically, a small gap may remain between the side regulating board and the sheet P. The remaining gap may cause the skew of the sheet P when feeding and conveying the sheet P and may cause the position deviation in the width direction.

Thus, when setting the sheet P in the sheet storage, due to the influence caused by a play between the width of the side regulating board and the width of the sheet P or caused by a vibration due to inserting and removing of the sheet feeding cassette etc., the center position of the sheet P may be shifted toward a front side or a back side. There may also be a case where the size of the sheet P is a bit different from a nominal size. In this case, the center position of the sheet is held to be in an offset position by a certain constant value. In an image forming apparatus of a general type, in the prior art, since the deviation amount itself is used as the shift amount, the shift amount of the registration roller is increased accordingly. Further, the sheet P may be inclined during the conveyance of the same from the sheet storage, further, the sheet P may be shifted in the width direction and conveyed in the inclined state. In order to prevent the above situation, a skew correction etc. is performed by a sheet conveying device 100 provided in the image forming apparatus 1. Details of the above will be described as below.

In the sheet conveying device 100, the tip of the conveyed sheet P is moved toward the nip portion of the pair of the registration rollers 110 to contact with the same. Thus, the sheet P is curled to align the tip of the sheet P along the nip portion, thereby the skew is corrected. It is noted that the moving amount of the sheet P is set to obtain a proper amount of the arch by curling the sheet P. The moving amount is an amount of a movement of the sheet P caused by the pair of the pre-registration rollers 120 after the tip of the sheet P has passed the registration sensor 140.

It is noted that, between the pair of the registration rollers 110 on a conveying path and the pair of the registration rollers 120, a CIS (Contact Image Sensor) 141 for detecting a side edge position (i.e., the end position in the sheet width direction) in the width direction is provided. Based on the detection result detected by the CIS 141, the deviation amount between a nominal position (designed target position) and the detection result is calculated by the control unit 200, which is described later. The sheet conveying device 100 performs a shift action for shifting the pair of the registration rollers 110 to the width direction based on the calculated deviation amount. Thus, the sheet conveying device 100 performs the correction for causing the position of the sheet P in the width direction to be coinciding with the position of the image transferred by the image forming unit. Hereinafter, description is made with respect to the control unit for controlling the function and configuration of the image forming apparatus 1.

Figure 2:
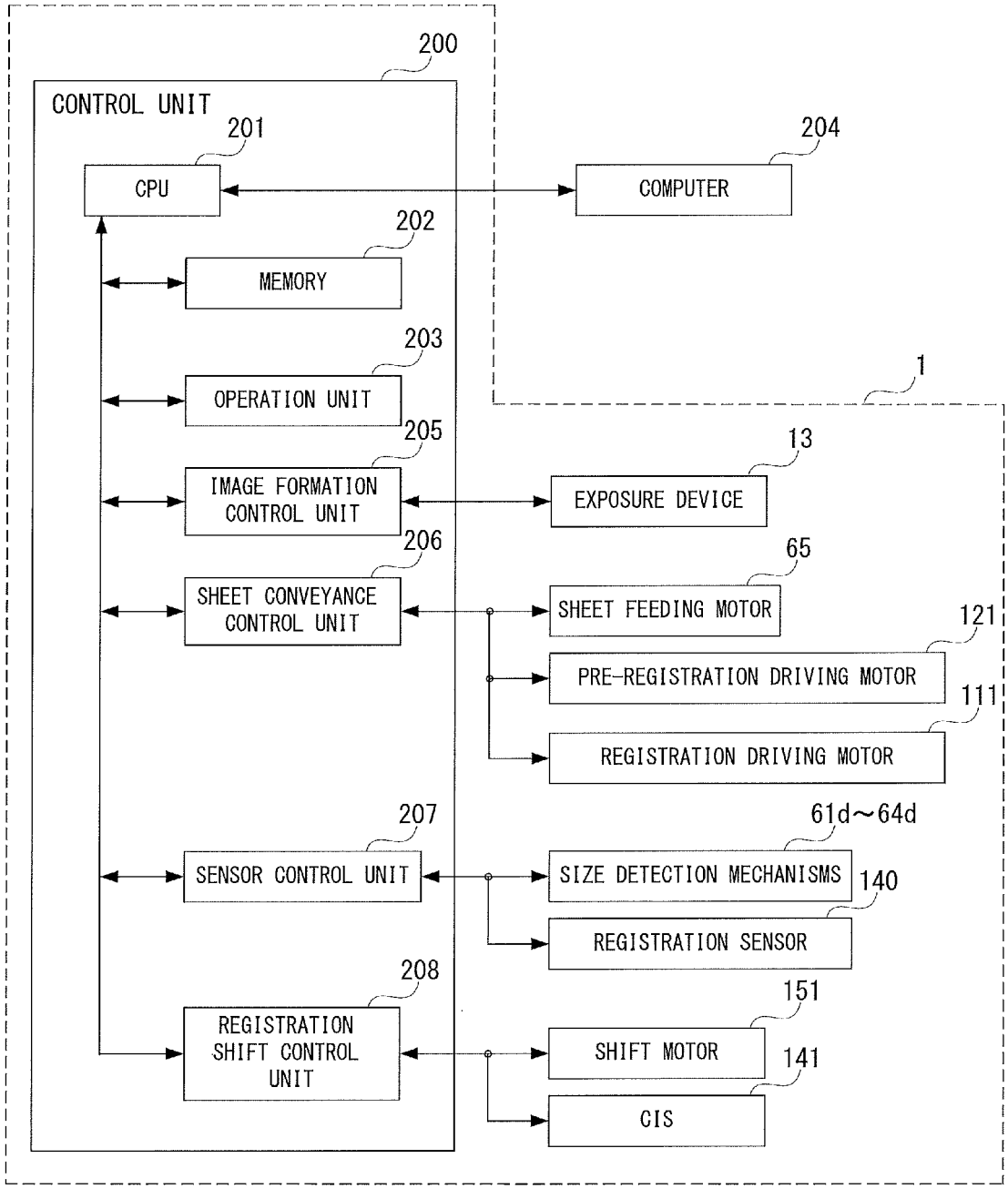
FIG. 2 is a block diagram for explaining a control unit of the image forming apparatus.

FIG. 2 is a block diagram for explaining the control unit of the image forming apparatus 1. The control unit 200 includes functional units including a CPU (Central Processing Unit) 201, a memory 202, an operation unit 203, an image formation control unit 205, a sheet conveyance control unit 206, a sensor control unit 207, and registration shift control unit 208 etc. The CPU 201 executes various processing to be performed by the image forming apparatus 1 by executing predetermined control programs etc. The memory 202 includes a RAM (Random Access Memory), a ROM (Read only memory), etc., for example, and stores various programs and various data in a predetermined storage area. The operation unit 203 receives various operations from the user such as printing and interruption of printing etc., and various information concerning the sheet used for printing (size information, basis weight information, surface nature information, etc.,).

The image formation control unit 205 issue instructions to the image forming unit which includes the exposure device 13, and controls image formation. The sheet conveyance control unit 206 provides instructions to a sheet feeding motor 65, a pre-registration drive motor 121 described later, a registration drive motor 111, etc., for controlling the conveyance of the sheet P. The sensor control unit 207 controls start or stop of a detection in the size detection mechanisms 61*d*-64*d* and the registration sensor 140, etc. Further, the sensor control unit 207 receives detection results obtained in the sensors. The registration shift control unit 208 receives the detection result of the CIS 141, provides instructions for starting or stopping of a shift motor 151 described later, etc., and controls the shift action in the sheet conveying apparatus 100 for shifting the pair of the registration rollers 110 in the width direction. Further, it is possible to provide a configuration in which various information concerning sheets used for printing can be received, for example, via a computer (for example, computer 204 illustrated in FIG. 2) connected via a network. Hereinafter, a specific configuration of the sheet conveying device 100 will be described.

Figure 3:
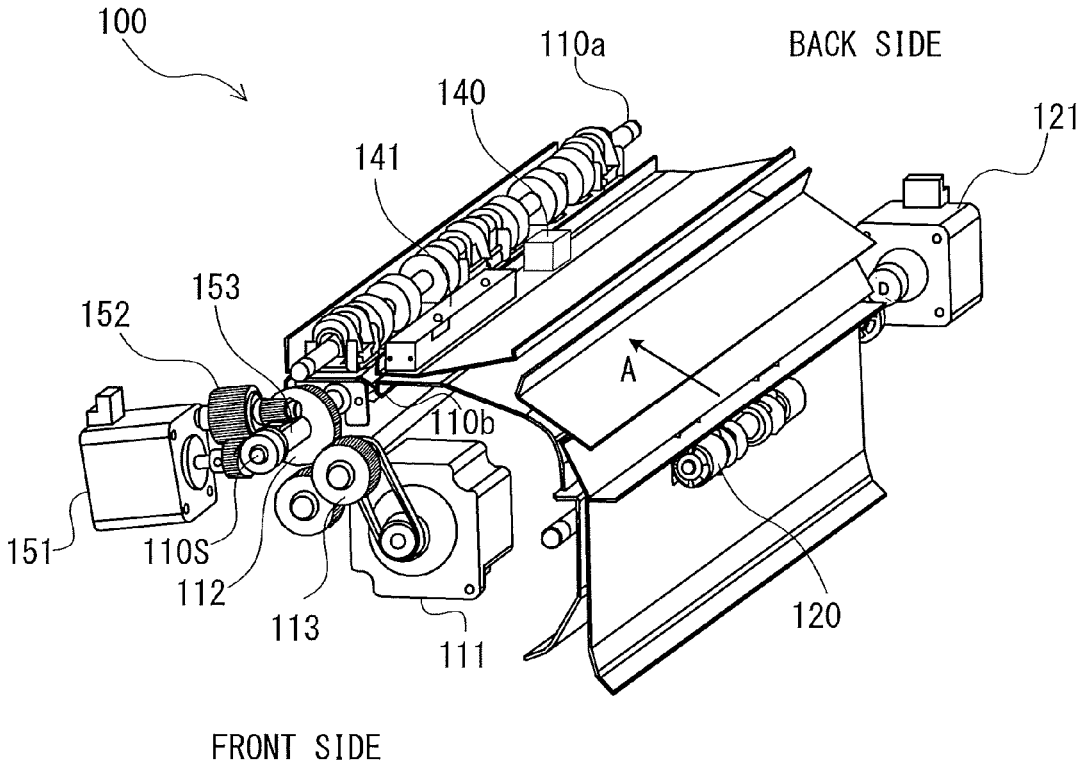
FIG. 3 is a perspective view illustrating a main configuration of a sheet conveying device.

FIG. 3 is a perspective view illustrating a main configuration of the sheet conveying device. It is noted that the sheet conveying device 100 is arranged within a conveying path between the image forming unit and the feeding units 61*a*-64*a*. In the sheet conveying device 100 illustrated in FIG. 3, is configured to include the pair of the registration rollers 110 (upper roller 110*a*, lower roller 110*b* and a rotating axis of the registration roller 110S), a registration driving motor 111 and a registration roller input gear 112. The sheet conveying device 100 further includes a registration roller idler gear 113 and the pair of the pre-registration rollers 120. The sheet conveying device 100 further includes a registration driving motor 121, the registration sensor 140, the CIS 141, the shift motor 151, a pinion gear 152 and a rack 153.

The pre-registration driving motor 121 drives to rotate the pair of the pre-registration rollers 120 provided in the sheet conveying path. The registration driving motor 111 drives to rotate the pair of the registration rollers 110 via the registration roller input gear 112 and the registration roller idler gear 113. It is noted that the pair of the registration rollers 110 includes the upper roller 110*a* and the lower roller 110*b* fixed to the rotating axis of a registration roller, and the rotating axis of the registration roller 110S is mounted to a main body of the apparatus for allowing movement in the width direction of the sheet. Further, upper roller 110*a* is configured such that it moves with the lower roller 110*b* in an integrated fashion, according to the movement of the rotating axis of the registration roller 110S in the width direction of the sheet P.

The rack 153 is configured such that it is allowed to rotate in the rotating direction and, as to the width direction, it is fixed and supported by the rotating axis of the registration roller 110S. That is, due to the rotation of the pinion gear 152, which is rotated by the driving force transmitted from the shift motor 151, the rack 153 moves in the width direction of the sheet P. Therefore, it becomes possible to move the sheet P nipped by the pair of the registration rollers 110 in the width direction. Thus, the shift action of the pair of the registration rollers 110 is achieved via the pinion gear 152 and the rack 153.

It is noted that, as compared to the registration roller input gear 112. The distance between the teeth of the registration roller idler gear 113 is comparatively large. This configuration is directed to maintain the engagement of the gears to allow the rotation of the pair of the registration rollers 110 even in a case where the pair of the registration rollers 110 and the registration roller input gear 112 have been moved in the width direction.

The CIS 141 for detecting the side edge position of the sheet P is provided upstream of the pair of the registration rollers 110. It is noted that CIS 141 is provided at the position offset from the center of the sheet P in the width direction, and the conveying direction is illustrated by the arrow A in FIG. 3. This is because it is sufficient to detect a side edge position of only one side of the sheet P in the position correction of the sheet P.

Further, the CIS 141 is configured such that it is possible to detect the side edge position for each of the sheet P which has the smallest width and the sheet P which has the largest width, among the sheet sizes allowed to be used for the image forming apparatus. It is noted that, in order not to reduce the detection precision of the CIS 141, the position at which the CIS 141 is provided is as close as the pair of the registration rollers 110. Further, it is desirable that the conveyance guide gap (not illustrated) of the CIS 141 is uniformly formed so that a space for receiving an arch portion generated by the curl of the sheet is provided between the CIS 141 and the pair of the pre-registration rollers. This is because the arch portion is generated in the sheet P between the pair of the pre-registration rollers 120 and the pair of the registration rollers 110, in order to perform the skew correction as described above.

Figure 4:
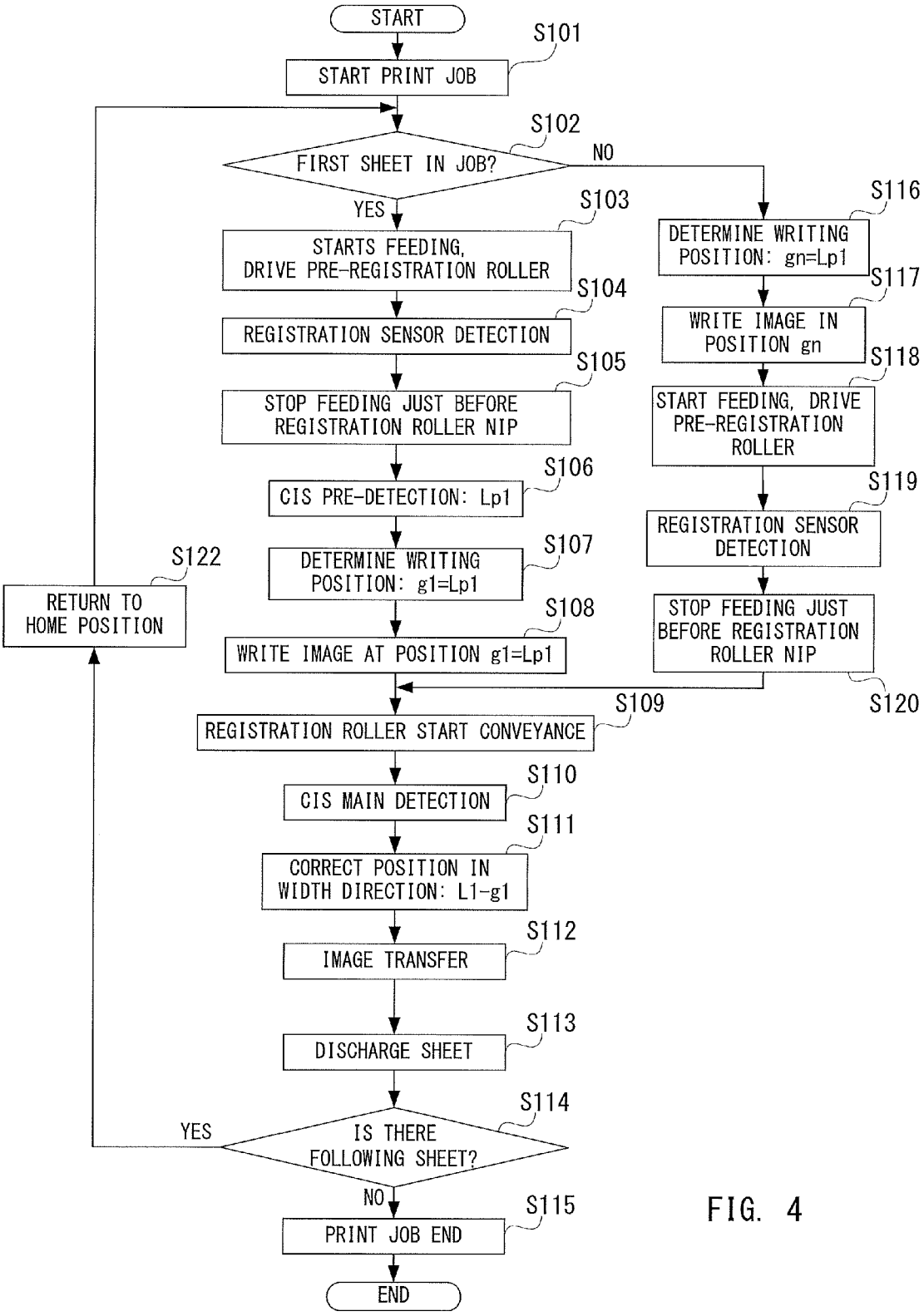
FIG. 4 is a flowchart illustrating a processing procedure of a shift processing of the image forming apparatus.
Figure 5:
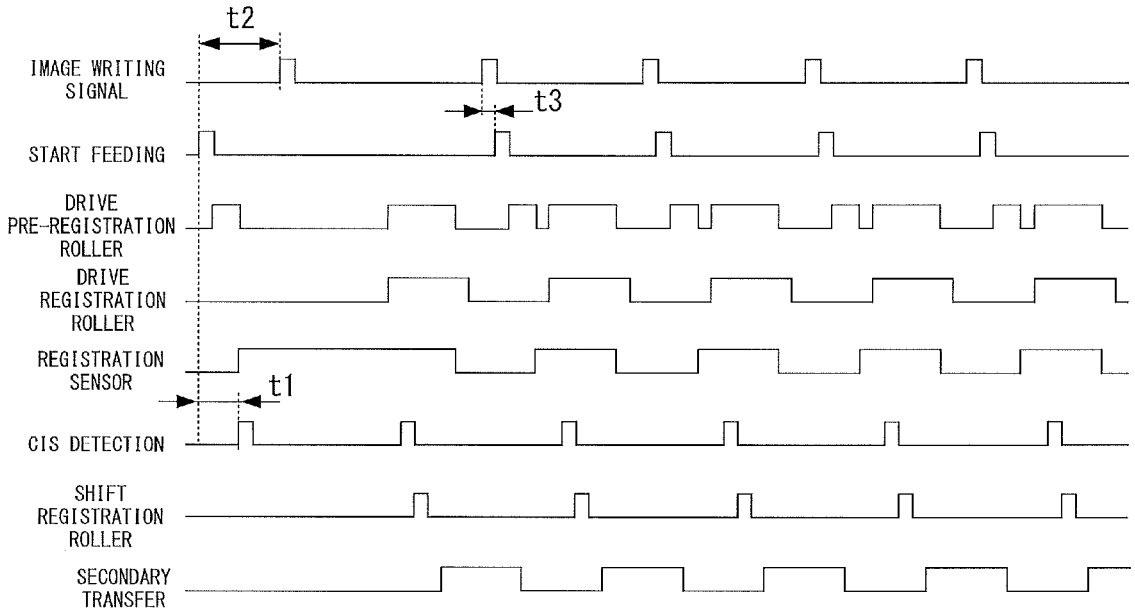
FIG. 5 is a timing chart of the processing procedure illustrated in FIG. 4.

FIG. 4 is a flowchart illustrating a processing procedure of a shift processing of the sheet P in the image forming apparatus 1. Further, FIG. 5 is a timing chart when this processing procedure is performed. FIGS. 6A to 6D are diagrams for explaining a position correction operation in a width direction and a skew correction operation for a sheet P in the sheet conveying device 100. The shift processing to the sheet P is explained using each of these figures. The control unit 200 starts a print job in response to a receipt of a print execution instruction from a user via the operation unit 203 or the computer 204 (S101). It is noted that a user may specify the type of the sheet used for printing etc., as well as specifying the number of prints etc. The control unit 200 obtains information of the sheets stored in each of the storage via the size detection mechanisms 61*d*-64*d*.

Figure 6A:
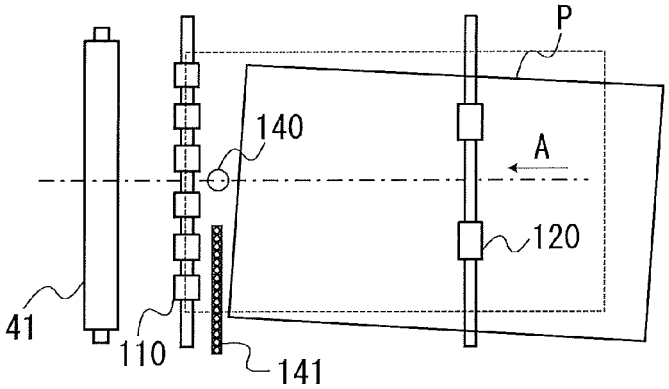
FIGS. 6A, 6B, 6C and 6D are diagrams for explaining a position correction operation in a width direction and a skew correction operation for a sheet P in the sheet conveying device 100.

The control unit 200 determines whether it is the first sheet in a print job or not (S102). If it is determined to be the first sheet (S102: Yes), the control unit 200 starts feeding of the sheet P, and conveys the sheet P to the pair of the pre-registration rollers 120 (S103). Here, assume that the conveyed sheet P is in an inclined state in which the sheet P is rotated in a clockwise direction relative to the conveying direction A, as illustrated in FIG. 6A. Note that the dotted rectangle illustrated in FIG. 6A schematically shows the state of sheet P which is conveyed without skew, with its tip contact with the pair of the registration rollers 110.

Figure 6B:
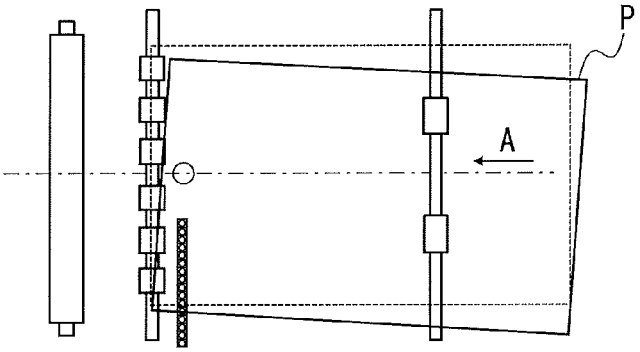
Figure 6C:
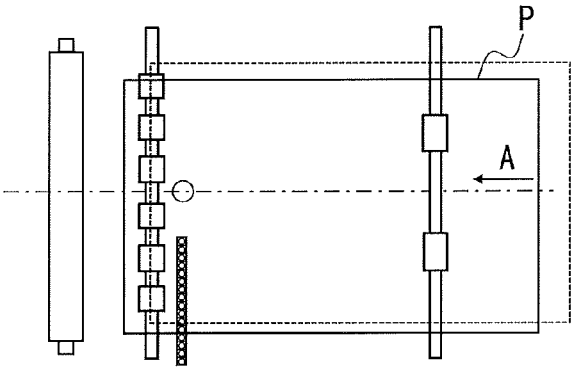

The control unit 200 continues, based on the detection result (S104) of the registration sensor 140 (refer to FIG. 3), the conveyance of the sheet P until it reaches a position just before the position at which the conveyed sheet P contacts with the nip portion of the pair of the registration rollers 110, then, stops the conveyance (S105, FIG. 6B). It is noted that the detection result of the registration sensor 140 is stored in the memory 202, for example. The control unit 200 executes a pre-detection by the CIS 141 (S106). The control for executing the pre-detection is one of the characteristic control of the image forming apparatus 1 of the present embodiment. It is noted that the detection result of the pre-detection by the CIS 141 is stored in the memory 202, for example.

Here, the CIS 141 is provided upstream of the pair of the registration rollers 110, as described above. Therefore, it is possible to detect the side edge position of the sheet P just before the nip portion of the pair of the pre-registration rollers 110 while the conveyance of the sheet P is stopped. On the other hand, before starting of writing an image, various pre-adjustments of an image formation process are performed. Therefore, the period for these pre-adjustments take is required. At this point, in the image forming apparatus 1, feeding of the sheet P is started after starting the print job. Further, in the image forming apparatus 1, the period required for the sheet P to reach the detection position of the CIS 141 (period t1: FIG. 5) and the period after the operation of the pre-adjustments until the starting of writing of an image (period t2: FIG. 5) have a relation, i.e., "period t1<period t2". Therefore, the timing to start writing the image which is caused by the pre-detection by the CIS 141 will not be delayed.

It is noted that, in the state illustrated in FIG. 6B, the skew correction of the sheet P has not been performed. The pre-detection by the CIS 141 may be detected with higher precision when performed after the skew correction, as compared to when performed before the skew correction. However, even in a case where the pre-detection is performed before the skew correction, as in the image forming apparatus 1, the influence on detection precision is not so large. For example, assume that the distance from the CIS 141 to the pair of the registration rollers 110 in the conveying path is 25 [mm], and the skew amount of the sheet P is 3.5 [mm]. Here, the skew amount is defined as the difference, at the front edge, of the position between the both side edges in the conveying direction. In this case, since the detection of the side edges is performed in the position near the front edge of the sheet, the error generated in the pre-detection is about 0.2 [mm], which is so small that it does not have substantial influence on the precision of the detection.

Returning to the explanation of FIG. 4, the control unit 200 determine, based on the detection result (Lp1) of the process of step S106, the image exposure position (image writing position) (g1) in the main scanning direction which is perpendicular to the moving direction of the photoreceptor 11 (S107). The image writing position g1 in this case is as follows: g1=Lp1. Note that each of the content determined in each process is stored in the memory 202, for example. The control unit 200 controls the exposure to the photoreceptor 11 to write the image in the determined image writing position (g1=Lp1) (S108). Then, the sheet is moved by the pair of the pre-registration rollers 120 by the specified moving amount. The tip of the sheet P is moved toward the nip portion of the pair of the registration rollers 110 to contact with the same, thereby the sheet P is curled to form an arch portion having a predetermined height. Thus, the skew correction of the sheet P is performed and the sheet P will be in the state illustrated in FIG. 6C. The control unit 200 starts rotation of the pair of the registration rollers 110, and restart conveyance of the sheet P (S109).

The control unit 200 executes a main detection by the CIS 141 for the sheet P for which the skew correction has been performed (S110). Based on this detection result (L1), a sheet position correction amount (correction amount in the sheet width direction) is determined. The detection result (L1) of the main detection by the CIS 141 is subtracted by the image writing position (g1), thereby the sheet position correction amount in this case is determined based on the result of the subtraction (L1−g1). It is noted that the detection result of the main detection by the CIS 141 is stored in the memory 202, for example.

Figure 6D:
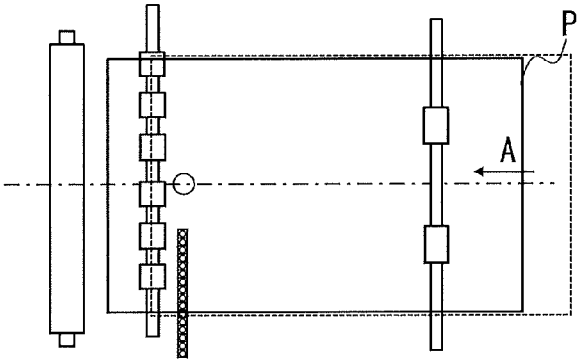

The control unit 200 shifts, via the registration shift control unit 208 and shift motor 151, the pair of the registration rollers 110 which is conveying the sheet P by the sheet position correction amount (L1−g1) (S111). FIG. 6D illustrates a state in which the pair of the registration rollers 110 is shifted by the determined sheet position correction amount. Thereafter, the control unit 200 transfers an image (toner image) to the sheet P in the secondary transfer unit, and fixes the toner image via fixing device 50 (S112). Then, the sheet P on which the toner image is fixed is discharged to the discharge unit 80 (S113). Thus, the shift amount of the pair of the registration rollers 110 according to the determined image writing position is determined. Therefore, the shift amount of the pair of the registration rollers 110 can be reduced.

The control unit 200 determines whether there is a following sheet or not (S114). If it is determined that there is no following sheet (S114: No), the print job is ended (S114). Otherwise (S114: Yes), the pair of the registration rollers 110 is returned to a home position (center position) (S122). Thereafter, the process returns to Step S102.

When it is determined to be the second or subsequent sheet in the print job (S102: No), the control unit 200 determines the image writing position (gn) in the main scanning direction of the photoreceptor 11 (S116). The image writing position gn in this case is represented by: g=Lp1. For the second and subsequent prints, the image writing position gn is a fixed value. Here, referring to FIG. 5, description is made for the reason why the image writing position gn is fixed to gn=Lp1. In the timing chart shown in FIG. 5, a print job in which 5 sheets from the storage are conveyed is shown. In the timing chart illustrated in FIG. 5, the control for the second sheet to the n-th sheet differs from that for the first sheet in the point that the image writing is started earlier than the start of the feeding by the time t3 due to time constraints. Therefore, it is not possible to perform the pre-detection by the CIS 141 before the skew correction for the n-th sheet. In this case, the pre-detection result (Lp1) for the first sheet is applied to the image writing position of the n-th and subsequent sheets.

Returning to the explanation of FIG. 4, the control unit 200 writes the image in the determined image writing position (gn=Lp1) (S117). The control unit 200 starts the feeding of the sheet P, and conveys the sheet P to the pair of the pre-registration rollers 120 (S118). The control unit 200 continues, based on the detection result (S119) of the registration sensor 140, the conveyance of the sheet P is continued until it reaches a position just before the position at which the conveyed sheet P is nipped by the nip portion of the pair of the registration rollers 110, then, stops the conveyance (S120). Since the subsequent processing is similar to that in the printing of the first sheet, the description thereof is omitted.

Figure 7:
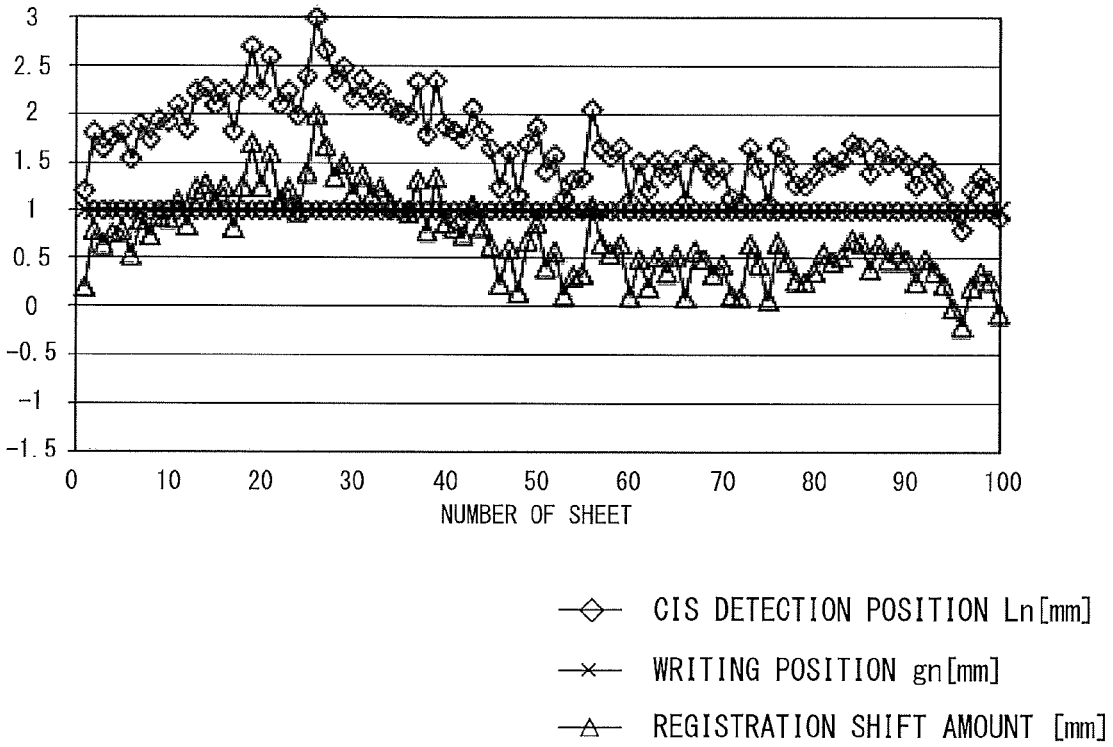
FIG. 7 is a graph in which each of a CIS detection position Ln, an image writing position gn and register shift amounts, when 100 sheets are continuously fed in the image forming apparatus, are plotted.

FIG. 7 is a graph in which each of the CIS detection position Ln, the image writing position gn and shift amounts, when 100 sheets are continuously fed in the image forming apparatus, are plotted. In the graph illustrated in FIG. 7, since Lp1=1.0 [mm] in the pre-detection of 1st sheet and L1=1.2 [mm] in the main detection, therefore, from the graph, the shift amount is found to be 0.2 [mm]. Further, the image writing position gn for the second and subsequent sheets is found as follows: gn=Lp1=1.0 [mm]. Therefore, for Ln, it is found that the shift amount reaches 3.0 [mm] in the maximum. However, the register shift amount is suppressed to 2.0 [mm] even at the maximum.

Thus, in the image forming apparatus 1 according to this embodiment, the conveyance of the sheet P is stopped just before the position at which the conveyed sheet P is nipped by the pair of the registration rollers 110, then, the pre-detection of the side edge position of the sheet in the width direction is performed by the CIS 141. Then, the image writing position is determined according to the result of the pre-detection. Further, the shift amount of the pair of the registration rollers 110 is determined according to the detection result of the pre-detection by the CIS 141, i.e., the image writing position. Therefore, the shift amount of the pair of the registration rollers 110 can be reduced. That is, for all the sheets including the first sheet of the print job, both the time required for the shift action by the pair of the registration roller 110 and the time for returning after the shift action are reduced. As a result, while improving productivity, the deterioration of the skew correction and that of the shift correction accuracy, due to a large shift amount, are prevented.

In the above description, the CIS 141 is provided in the upstream side and just before the pair of the registration rollers 110, and the pre-registration is performed to the sheet P which is stopped at the position just before the nip of the registration rollers 110. However, not limited to the above, it is possible to provide the CIS 141 downstream of the pair of the registration rollers 110. That is, it is possible to control the image forming apparatus 1 such that the sheet tip of the first sheet in a job exceeds the CIS 141, the pre-detection is performed while the sheet is being stopped at the upstream side of the transferring unit, then the image writing is started, and the toner image on the intermediate transfer belt is transferred to the sheet P in the secondary transfer unit. Due to the control described in the above, it is expected to obtain the same effect, i.e., minimizing the shift amount in the above configuration.

Second Embodiment

In this embodiment, description is made for an image forming apparatus in which various adjustment controls for image forming processing are carried out for every predetermined number of sheets. Specifically, when the interval of the continuously conveyed sheets, i.e., the conveyance interval (the interval between the sheets) between a preceding sheet and a subsequent sheet, is increased by various adjustment controls etc., as compared to the normal operation, the apparatus of the embodiment can effectively use the increased time. Note that the same symbols are used for the functional components which are identical to those as already described in the first embodiment and the description thereof will be omitted.

Figure 8:
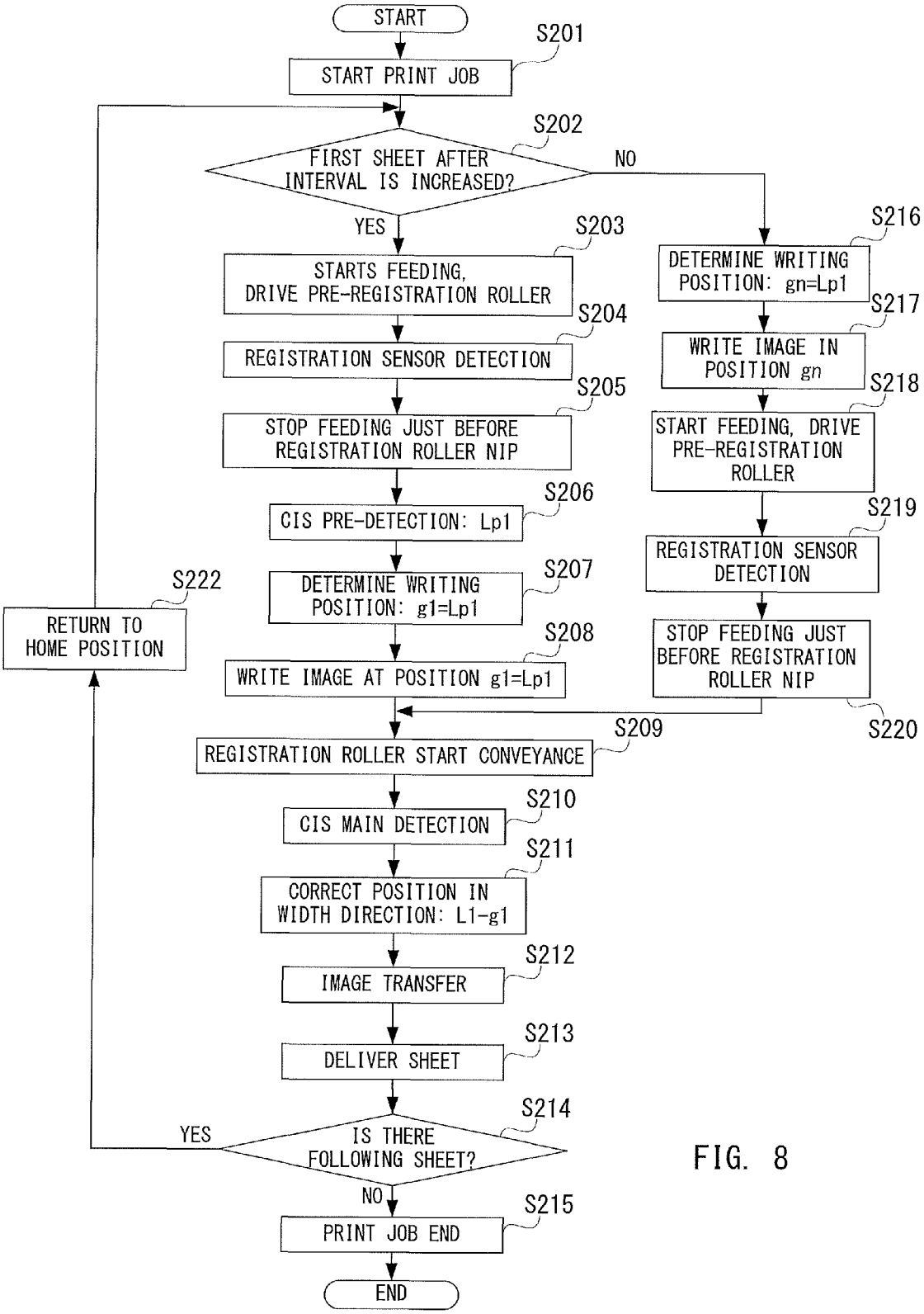
FIG. 8 is a flowchart illustrating a processing procedure of a shift processing of the image forming apparatus of a second embodiment.

FIG. 8 is a flowchart illustrating a processing procedure of a shift processing of the image forming apparatus of this embodiment. It is noted that the flow chart illustrated in FIG. 8 differs only in the process of step S102 in the flow chart illustrated in FIG. 4. Hereinafter, this different process is mainly explained, and explanation for the other processes is omitted.

The control unit 200 starts a print job in response to a receipt of a print execution instruction from a user via the operation unit 203 or the computer 204 (S201). The control unit 200 determines whether it is the first sheet after the interval between the sheets is increased beyond a predetermined value in a print job or not (S202). If it is determined to be the first sheet after the interval between the sheets is increased beyond a predetermined value, (S202: yes), the process proceeds to Step S203. In this case, the processes of step 203 and the subsequent steps are identical to the steps when it is determined to be the first sheet in a job (S102: Yes, FIG. 4). That is, when the interval between the sheets is increased as compared to the normal operation due to the various adjustment controls etc., the increased time is used for performing the pre-detection by the CIS 141.

Otherwise (S202: No), the control unit 200 proceeds to Step S216. In this case, the processes of step 216 and the subsequent steps are identical to the steps when it is determined to be the second or subsequent sheet in the first embodiment (S102: No, FIG. 4). It is noted that, as to the determination whether the interval between the sheets is increased as compared to the normal operation, i.e., whether the interval is increased beyond the predetermined value or not, the control unit 200 perform the determination based on the detection result, performed by the registration sensor 140, to the sheet P conveyed. Further, the predetermined value in this case is set as a period of time or a distance, for example.

Thus, in the image forming apparatus according to this embodiment, the additional period which occurs when the interval of the continuously conveyed sheets is increased may be used as a period for the pre-detection by the CIS 141. Therefore, when printing the second and subsequent sheets, for example, it is possible to control to minimize the shift amount of the pair of the registration rollers 110.

Third Embodiment

In this embodiment, description is made for a control where different storages, to which the sheets are fed, are used when the print job is executed or performing the next job. Specifically, description is made for an operation for controlling an image writing position for the first sheet after the storage to be used is switched. Thus, in the image forming apparatus according to this embodiment, the control of the image writing position of the first sheet after switching the sheet storage is different from the control of each of the image forming apparatuses of the first and second embodiments. In this embodiment, description is made mainly for the difference, and the same symbols are used for the functional components which are identical to those as already described in the first and the second embodiments, and the description thereof will be omitted.

Figure 9:
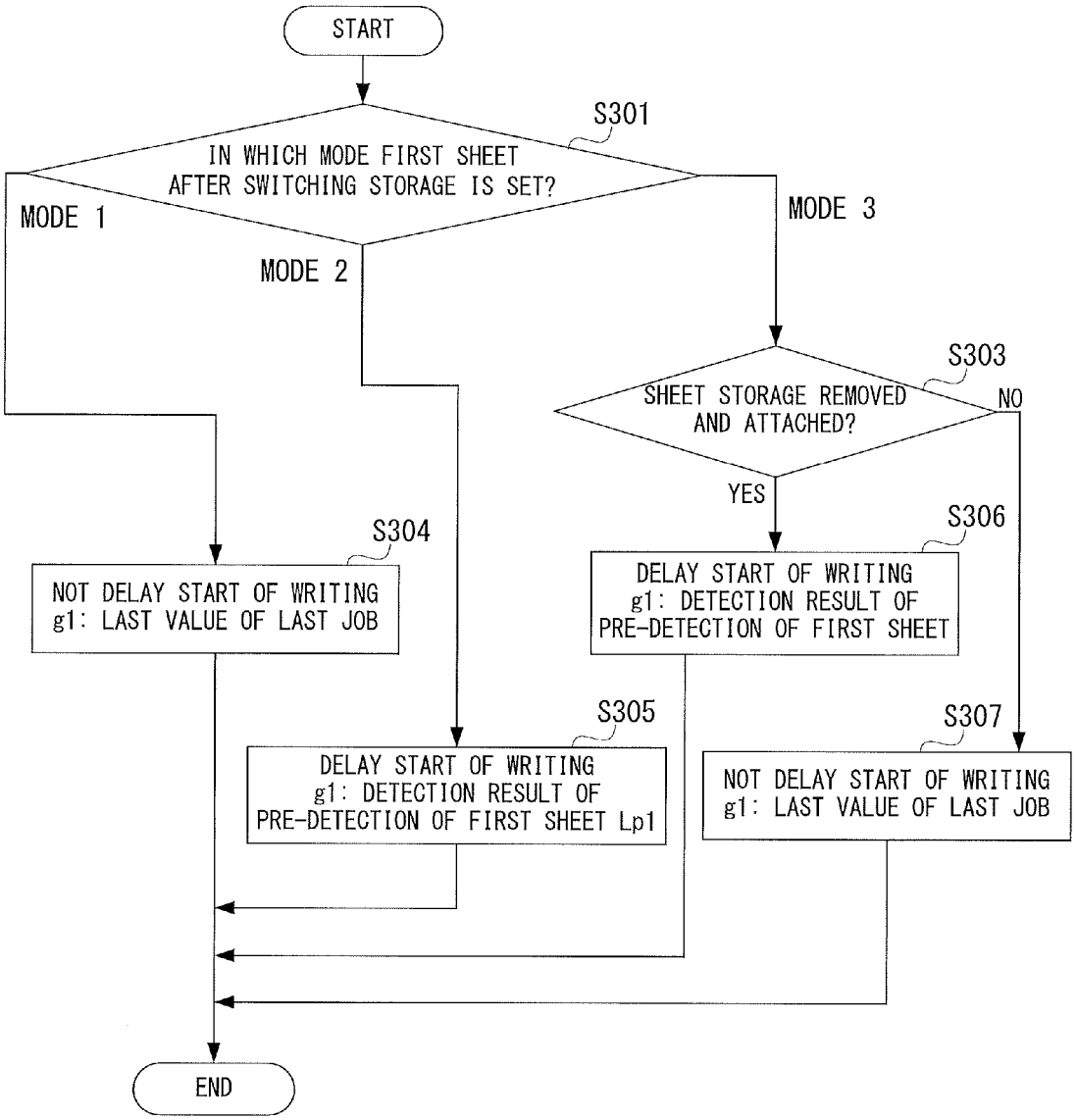
FIG. 9 is a flowchart illustrating a processing procedure for specifying the control mode of the image forming apparatus according to a third embodiment.

The image forming apparatus of this embodiment has three different control modes, and description is made for these modes with reference to FIG. 9. For example, after printing to the sheet fed from a storage A, when the storage to be used is changed from the storage A to a storage B, it is necessary to perform different controls in response to the result of a determination whether it is the first print after the storage B is removed from and attached to the image forming apparatus or not. It is because there is a possibility that the width direction position of the sheet in the storage may be changed by removing and attaching the storage. However, in a case where the printing to the sheet fed from the storage B has been performed before the printing to the sheet fed from the storage B and the removing and attaching (supplying sheets or replacing sheets) of the storage B to the image forming apparatus has not been performed thereafter, the position of the sheet in the storage is not changed. Therefore, even in the printing after switching the storage A to the storage B, the image writing position which is previously determined when forming an image on the sheet fed from the storage B can be used. In this case, it is not necessary to perform the pre-detection. On the other hand, when the storage B has been removed from and attached to the image forming apparatus before switching to the storage B and the printing to the sheet fed from the storage B has not been performed after the removing and attaching of the storage, it is desirable to perform the pre-detection to the first sheet after switching to the storage B. However, by performing the pre-detection, productivity is decreased. In addition, when the storage to be used is switched, giving priority to the accuracy of the image writing position, some users require to perform the pre-detection irrespective of whether the storage has been removed and attached. Therefore, as the initial setting modes for the image forming apparatus, three modes are available to be set. The first mode (high throughput mode) is a mode in which the pre-detection for the first sheet after switching of the storage is always inhibited irrespective of whether the storage has been removed and attached. The second mode (high precision mode) is a mode in which the pre-detection for the first sheet after switching of the storage is always performed irrespective of whether the storage has been removed and attached. The third mode (auto mode) is a mode in which whether the pre-detection for the first sheet after switching of the storage should be performed or not is determined based on whether the storage has been removed and attached or not. These initial settings are set by using the operation unit 203. FIG. 9 is a flowchart illustrating a processing procedure for specifying the control mode. The control unit 200 determines in which mode the control mode for the first sheet is set when the sheet storage to be used is switched (S301).

When the control mode is set to the first mode, the control unit 200 does not perform the pre-detection regardless of removal and attachment of the sheet storage, and determines the image writing position determined by the last print job which uses the same storage as the image writing position to the first sheet after the switching of the storage (S304). It is noted that, for each of the storages, the data of the image writing position in the last job is stored in the memory 202.

When the control mode is set to the second mode, the control unit 200 performs the pre-detection to the first sheet after the switching of the storage regardless of removal and attachment of the same. Then, the image writing position is determined based on the result of the detection (S305). In the second mode, by performing the pre-detection, as compared to the first mode, the image writing start timing is delayed, therefore, the productivity is decreased a little. Hereinafter, description is made in detail for the first mode and the second mode with reference to FIG. 10.

Figure 10A:
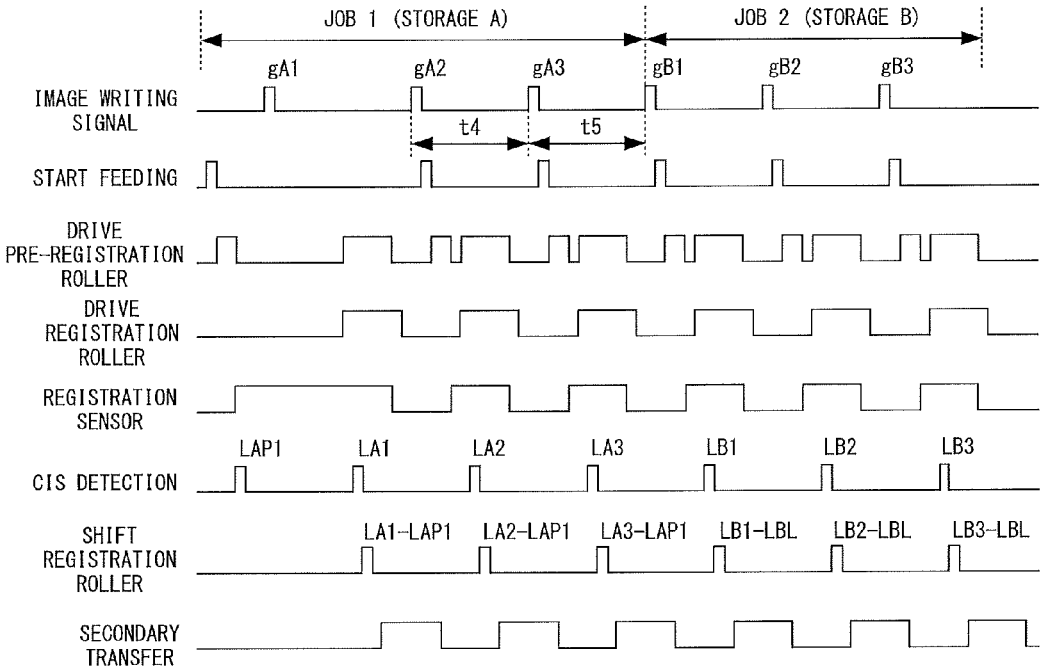
FIGS. 10A and 10B are timing charts corresponding to the states of the image forming apparatus (mode 1, mode 2).
Figure 10B:
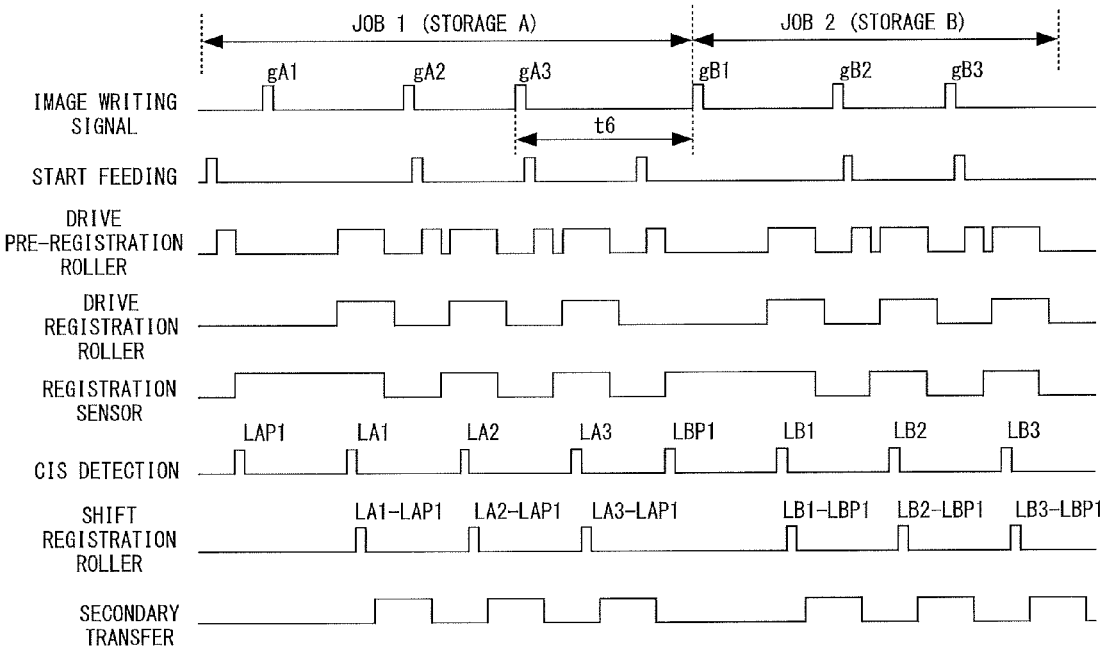

FIG. 10A is a timing chart in a case where the image formation is controlled in the first mode. FIG. 10B is a timing chart in a case where the image formation is controlled in the second mode. In each of the timing charts, after a job 1 in which 3 sheets are fed from the storage A, the storage A is switched to the storage B and a job 2 in which 3 sheets are fed from the storage B is successively performed. Thus, each timing chart represents an operation in which the storage to be used is switched during successive image forming.

In the timing chart illustrated in FIG. 10A, the control for the first sheet fed from the storage A is identical to that for the first sheet which has already been explained with reference to FIG. 5. It is noted that the detection result of the pre-detection by the CIS 141 (LAP1) represents the image writing position of the first sheet in the main scanning direction of the photoreceptor 11, and, for each of the second sheet and the third sheet, an image is written in the position of LAP1 with earlier timing as compared to the image writing timing of the first sheet. Here, the time t4 from the image writing timing of the second sheet to the image writing timing of the third sheet affects the productivity of the image forming apparatus. Further, in the first mode, the time t5 from the image writing timing of the third sheet from the storage A to that of the first sheet of storage B is identical to t4, i.e., t4=t5. Therefore, even if the storage to be used is switched, it does not affect the productivity. That is, the first mode is a mode with high productivity. Although not illustrated in FIG. 10A, in a case where the image writing position of the sheet P which is the last fed sheet from the storage B before the job 1 is set to "LBL", the image writing position of the first sheet in the job 2 is set to "LBL". It is noted that each of the latest image writing position of the sheet P fed from each of the sheet storages is related to the sheet storage and stored in the memory 202, for example. In addition, the image writing position in this case is changed to the image writing position related to the sheet storage each time the sheet storage for feeding is switched.

Next, FIG. 10B is different from FIG. 10A in the point that the image writing timing for the first sheet from the storage B is delayed by a predetermined time, i.e., t6 (>t5), as compared to the image writing timing for the third sheet from the storage A. That is, the pre-detection to the first sheet from the storage B is performed by the CIS 141, then, the image writing position is determined to be LBP1 based on the result of the detection, and the image writing is started. Thereby the shift amount of the pair of the registration rollers 110 is set to be "LB1−LBP1".

It is noted that while the high productivity is obtained in the first mode, the shift amount of the pair of the registration rollers 110 in the job 2 might be increased. On the other hand, in the second mode, as different from the first mode, the shift amount of the pair of the registration rollers 110 in the job 2 can be minimized, the improvement in productivity is less than that in the first mode. Therefore, the third mode described later is a mode of control for obtaining both of improved productivity and reduction of the shift amount as much as possible.

Returning to FIG. 9, the control unit 200, when the control mode is set to the third mode, determines whether removal and attachment of the switched sheet storage has been occurred and it is the first feeding after the occurrence of removal and attachment (S303). In a case where it is determined that removal and attachment of the switched sheet storage has been occurred and it is the first feeding after the occurrence of removal and attachment (S303: Yes), the control unit 200 performs pre-detection, the pre-detection to the first sheet from the storage B is performed by the CIS 141, Then, the image writing position is determined based on the result of the detection (S306). Further, in a case where it is not the first feeding after the occurrence of removal and attachment (S303: No), the control unit 200 does not perform the pre-detection to the first sheet after the switching of the storage, and determines the image writing position determined by the last print job which uses the same storage as the image writing position of the first sheet after the switching of the storage (S307). Hereinafter, description is made in detail for the third mode with reference to FIGS. 11A and 11B.

Figure 11A:
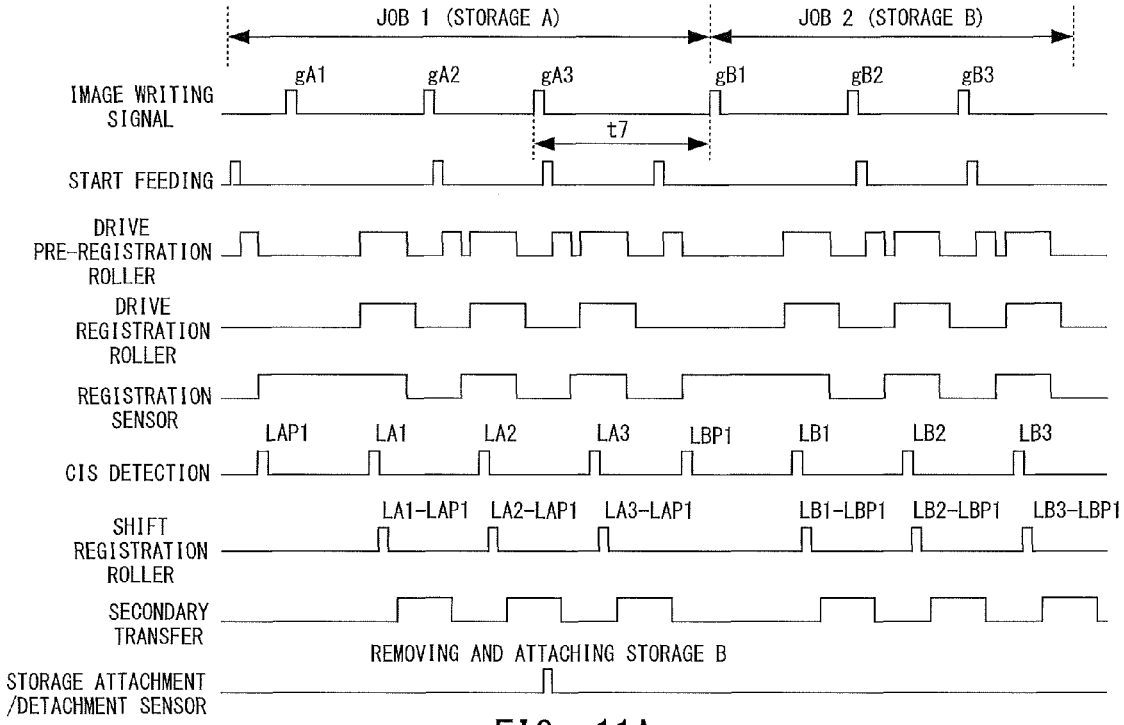
FIG. 11A is a timing chart when attachment and detachment of a sheet storage occur.
Figure 11B:
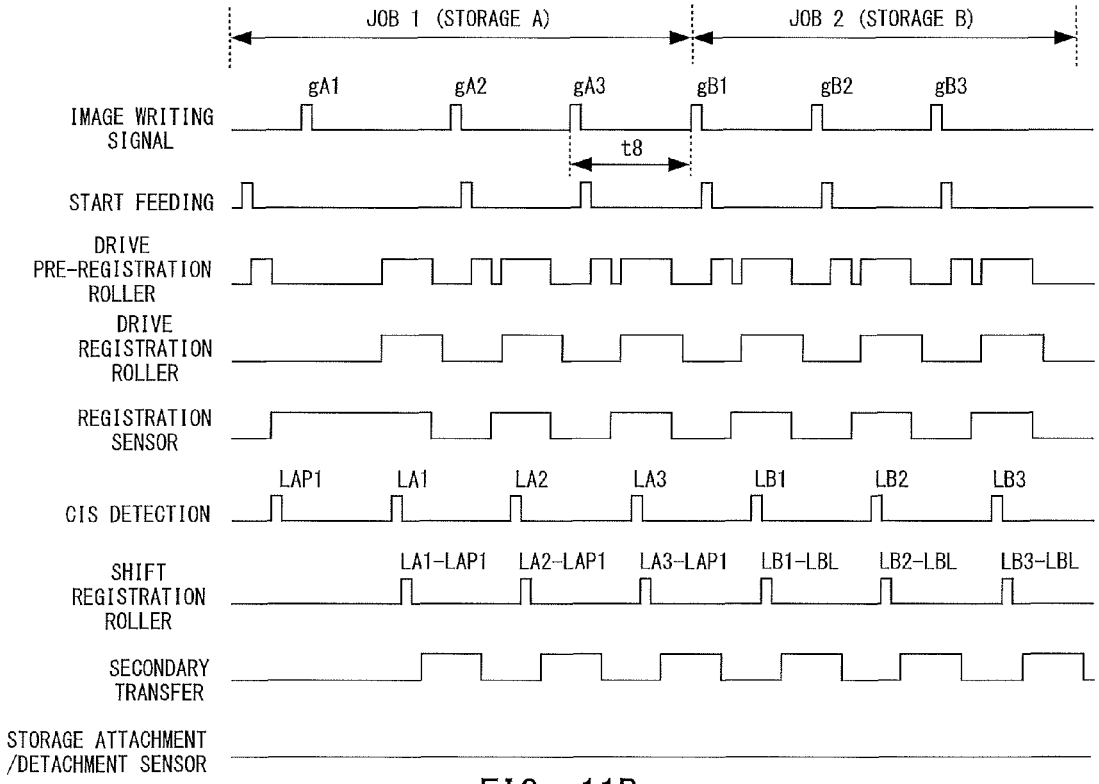
FIG. 11B is a timing chart when the attachment and the detachment of the sheet storage do not occur.

FIG. 11A is a timing chart in a case where the switching of the sheet storage is performed after an occurrence of removal and attachment of the same sheet storage, and the first sheet after the switching of the storage is the first feeding after the occurrence of removal and attachment. FIG. 11B is a timing chart in a case where there is no occurrence of removal and attachment of the sheet storage, or the first sheet after the switching of the storage is not the first feeding after the occurrence of removal and attachment. In each of the timing charts, after a job 1 in which 3 sheets are fed from the storage A, a job 2 in which 3 sheets are fed from the storage B is successively performed.

For example, when the sheet storage is opened, the position of the sheet P stored may be shifted in the width direction. Specifically, in some sheets which is supplied or replaced by a user, the size itself of the sheet P to be used in printing may differ a little from the sheet before the supplying/replacing the sheet. In addition, the sheet position may be changed due to the positioning by a position regulating board in the storage or removal and attachment of the sheet storage. Even in such cases, in FIG. 11A, the image writing timing for the first sheet from the storage B is delayed by the time t7 as compared to the image writing timing for the third sheet from the storage A. Further, as in the above described second mode (FIG. 10B), the CIS 141 performs the pre-detection (LBP1), and starts writing of the image. Thereby the shift amount of the pair of the registration rollers 110 is set to be "LB1−LBP1".

On the other hand, in FIG. 11B, as in the above described first mode (FIG. 10A), the image writing position LBL of the sheet P which is the last fed sheet from the storage B before the job 1 is set to the image writing position of the first sheet after switching the storage. In this case, the time t8 between the image writing timing of the third sheet of job 1 and that of the first sheet of job 2 is less than the time t7, therefore productivity does not decrease. Thus, even in a case where removal and attachment of the sheet storage has occurred thus the sheet P might shift in the width direction, it is possible control to minimize the shift amount in the sheet width direction by decreasing the productivity in the first sheet. Further, when there is no removal and attachment of the sheet storage, the deviation amount of the sheet width direction is changed little from that of the last sheet fed from the storage. Therefore, it is possible to control to give priority in productivity.

Fourth Embodiment

In the present embodiment, description is made for an image forming apparatus which employs a method for determining the image writing position gn which is different from that in the in the first to the third embodiment. Specifically, in the image forming apparatuses according to the first to the third embodiments, the image writing position gn after the first sheet is set to a fixed value. The fixed value is set based on the result of the pre-detection to the sheet of the first sheet after a feed interval opens by the adjustment for the first sheet from a job start, or a maintenance, etc. Thus, in the image forming apparatus according to this embodiment, the image writing position of the n-th sheet is determined based on the detection result value (Ln) of the main detection of the side edge position of the sheet which is fed prior to the n-th sheet. Hereinafter, description is made with reference to FIGS. 12 and 13, and the same symbols are used for the functional components which are identical to those as already described in the first to third embodiments, and the description thereof will be omitted.

Here, the timing for starting the image writing to the n-th sheet is earlier than the timing at which the CIS 141 detects the n-th (n>=2) sheet, as described in the above. In this description, assume that if the sheet is the (n−p)th sheet, the timing at which the CIS 141 detects the (n−p)th sheet is earlier than the timing for starting the image writing to the n-th sheet. In addition, assume that the determination of the image writing position is performed using the detection results of the m sheets by the CIS 141. Further, the moving average value of these detection results by the CIS 141 from the (n−p−m+1)th sheet to the (n−p)th sheet is set to the image writing position gn. The image writing position gn is calculated by the formula 1 shown below.

$$gn=(\mathrm{Ln}-p-m+1+\mathrm{Ln}-p-m+2+\ldots+\mathrm{Ln}-p)/m \quad (1)$$

Figure 12:
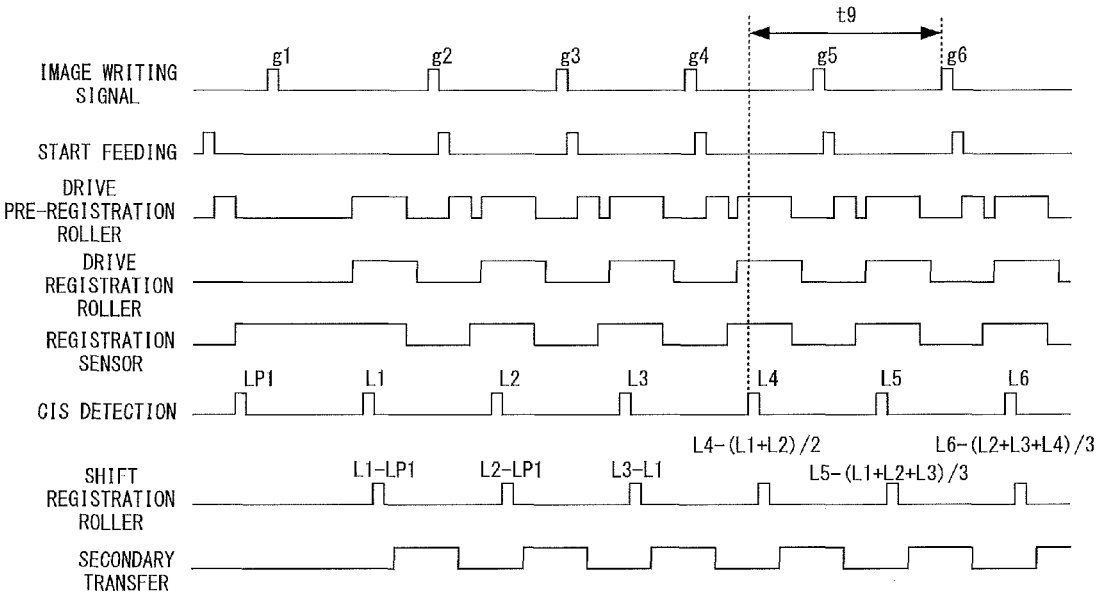
FIG. 12 is a timing chart for the image forming apparatus according to the fourth embodiment.

FIG. 12 is an example of the timing chart when p=2 and m=3 is set to the image writing positions for six sheets. For example, as to the 6th sheet, the detection results of the main detection for m sheets (i.e., 3 sheets since m=3) by the CIS 141 are averaged from the (6−p−m+1)th sheet (i.e., the 2nd sheet since p=2 and m=3) to the (6−p)th sheet (i.e., the 4th sheet since p=2), for calculating the image writing position. Specifically, the image writing position g6 is calculated by the formula 2 shown as follows.

$$g6=(L2+L3+L4)/3 \quad (2)$$

As a result, the shift amount in the sheet width direction is set to: L6−gn=L6−g6=(L2+L3+L4)/3.

However, for example, as to the 4th sheet, it does not work since n−p−m+1=4−2−3+1=0. In this case, the average value of these detection results (L1 and L2) by the CIS 141 from the first sheet to the (n−p)th sheet (i.e., the second sheet since (n−p)=(4−2)=2) is set to the image writing position g4. The image writing position g4 is calculated by the formula 3 shown below.

$$g4=(L1+L2)/2 \quad (3)$$

In the averaging process explained above, for example, in case where the deviation amount of one sheet has become considerably larger than others due to an unexpected variation, upon determining the image writing position for the subsequent sheets using the detected results obtained from the CIS 141, the influence of the unexpected variation can be decreased.

Figure 13:
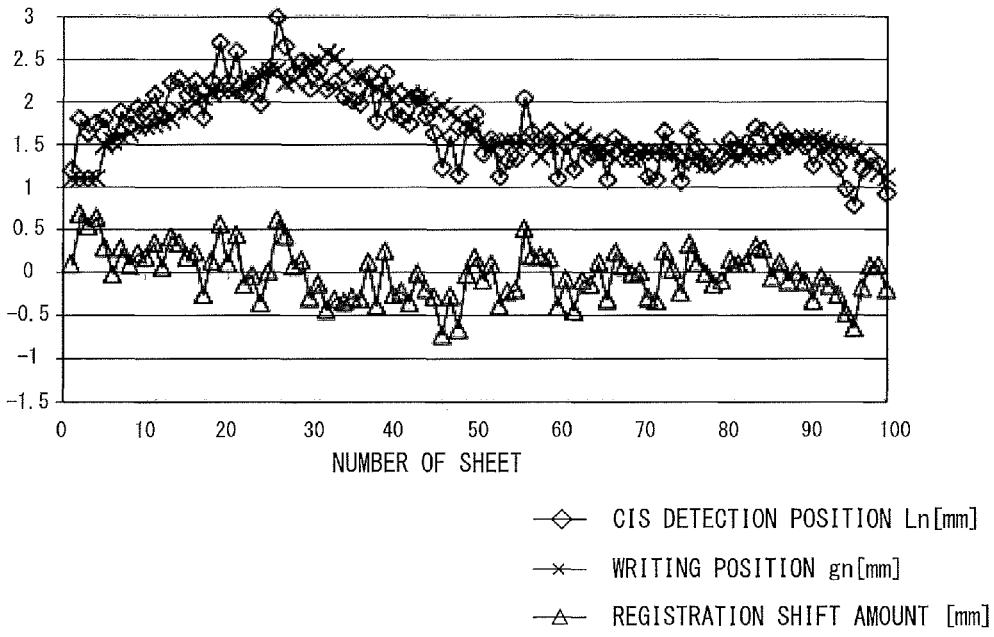
FIG. 13 is a graph in which each of a CIS detection position Ln, an image writing position gn and register shift amounts, when 100 sheets are continuously fed in the image forming apparatus, are plotted.

FIG. 7 is a graph in which each of the CIS detection position Ln, the image writing position gn and the shift amounts, when 100 sheets are continuously fed in the image forming apparatus of the present embodiment, are plotted. It is noted that the graph shows an example in which p=3 and m=5. The graph illustrated in FIG. 13 shows that the detection result by the CIS 141 starts from L1=1.2 [mm] for the first sheet, and takes the global maximum at L26=3.0 [mm] for the 26th sheet, and has a tendency for decreasing gradually until about the 50th sheet. On the other hand, by the above moving average process, the influence of the unexpected variation at the 26th sheet on the image writing positions of the 29th to 33rd sheets is minimized, further, the tendency for decreasing gradually until about the 50th sheet is also canceled. As a result, the shift amount is suppressed to about −0.7 [mm] to about +0.7 [mm], which is comparatively small.

It is noted that the above description is made for an example in which the image writing position is determined by a simple moving average. However, the determination of the image writing position is not limited to this method. What is necessary is just to determine an image writing position for a certain nth image based on the detection result(s) which is obtained by the CIS 141 for the former sheets. For example, when performing the averaging process for m sheets for the nth sheet, as the sheet number gets closer to "n", larger weighting coefficient may be applied. Further, when performing an averaging process, it is possible to control such that the unexpected deviation which is greater than a predetermined value may be neglected in the averaging process. Although the description is made with specific values, such as p=3, m=5, etc., the present disclosure is not limited to these specific values.

The detection position of the CIS 141 in the embodiments of the present disclosure can be arbitrarily set according to the configuration of a device. Actually, the image forming unit and the CIS 141, etc., are arranged with mechanical variations. Therefore, by considering the relative spatial relationship between the apparatuses and performing the image formation, the image writing position can be determined with higher precision. For example, in an adjustment at the time of manufacture, it is also possible to offset by a constant value for the variation in such deviations in the arranging positions. In such a case, the constant value in the adjustment at the time of manufacture is added to the image writing position described above, and the sum thereof is set to the actual image writing position.

As described above, the image forming apparatus of the present disclosure performs pre-detection of the side edge position of the sheet in the width direction when the first sheet fed is stopped just before the registration rollers, then, the image writing position is determined based on the result of the detection. Further, based on the image writing position determined for the first sheet and the detection result of the pre-detection for the second sheet following the first sheet, the shift amount of a pair of rollers for the second sheet (for example, the pair of the registration rollers) is determined. Thereby, the shift amount at the time of shifting a sheet in the width direction can be controlled.

The present invention has been described in detail by way of the above-mentioned embodiments, but the scope of the present invention is not limited to those embodiments.

While the present invention has been described with reference to exemplary embodiments and it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-107515, filed May 23, 2014 which is hereby incorporated by reference wherein in its entirety.

What is claimed is:

1. An image forming apparatus for forming an image on a sheet conveyed on a conveying path, comprising:

an exposure unit configured to expose an image carrier to write the image on the image carrier;

a pair of rollers configured to convey the sheet with the sheet nipped by the pair of rollers and to shift the sheet conveyed in a width direction which is perpendicular to the conveying direction of the sheet;

a detector configured to detect a side edge of the sheet conveyed to detect the side edge position of the sheet in the width direction;

a skew corrector configured to correct a skew of the sheet conveyed on a conveying path and a controller, wherein the controller is configured to:

determine an image writing position by the exposure unit for a first sheet in a main scanning direction which is perpendicular to a moving direction of the image carrier, based on a first detection result of the first sheet by the detector performed at a timing before a correction of a skew of the first sheet by the skew corrector;

control the exposure unit to write an image to be formed on the first sheet at the determined image writing position;

determine a first shift amount of the pair of the rollers for the first sheet, based on a second detection result of the first sheet by the detector at a timing after a correction of a skew of the first sheet by the skew corrector;

control a shift operation of the pair of rollers to shift the first sheet by the first shift amount;

control the exposure unit to write an image to be formed on the second sheet at the image writing position determined for the first sheet;

determine a second shift amount of the pair of the rollers for the second sheet, based on the image writing position determined for the first sheet and a detection result of the detector for the second sheet at a timing after a correction of a skew of the second sheet by the skew corrector; and control a shift operation of the pair of the rollers to shift the second sheet by the second shift amount.

2. The image forming apparatus according to claim 1, wherein the controller is further configured to:

determine, when a conveying interval between the first sheet and the second sheet exceeds a predetermined value, an image writing position for the second sheet based on the detection result of the second sheet by the detector at a timing before a correction of a skew of the second sheet by the skew corrector.

3. The image forming apparatus according to claim 1, wherein the detector is provided upstream of the pair of the rollers on the conveying path.

4. The image forming apparatus according to claim 1, further comprising at least two sheet storage units, each of which stores the sheet, wherein the controller is further configured to delay the start timing of the image writing for every time after switching the sheet storage unit used in the job, as compared to that of the image writing before the switching, by a predetermined time, and configured to control the detector to perform the detection of the side edge position.

5. The image forming apparatus according to claim 1, further comprising:

at least two sheet storage units each of which store sheets; and a memory configured to store each of the latest image writing position for the sheet fed from each of the sheet storage units with the image writing position being related to the sheet storage unit from which the sheet is fed, wherein the controller is further configured to control the image writing position, when there is no occurrence of removal and attachment of the sheet storage unit, to be changed to the position corresponding to the switched sheet storage unit for every time after switching of the sheet storage unit from which the sheet is fed, based on the image writing position stored in the memory.

6. The image forming apparatus according to claim 5, wherein the controller is further configured to, when there has been removal and attachment of the sheet storage unit from which the sheet is fed, delay the start timing of the image writing by a predetermined time, and configured to control the detector to perform the detection of the side edge position.

7. The image forming apparatus according to claim 1, wherein the pair of the rollers is a pair of registration rollers, and further comprising:

a pair of rollers which is provided upstream of the pair of the registration roller on the conveying path configured to correct skew of the sheet by conveying the sheet to move the tip of the sheet to contact with the nip portion of the pair of the registration rollers.

8. The image forming apparatus according to claim 1, wherein the detector is provided downstream of the pair of the rollers on the conveying path.

9. An image forming apparatus for forming an image on a sheet conveyed on a conveying path, comprising:

an exposure unit configured to expose an image carrier to write the image on the image carrier;

a pair of rollers configured to convey the sheet with the sheet nipped by the pair of rollers and to shift the conveyed sheet in a widthwise direction which is perpendicular to the conveying direction of the sheet;

a detector configured to detect a side edge of the conveyed sheet to detect the side edge position of the sheet in the widthwise direction;

a skew corrector configured to correct a skew of the conveyed sheet on a conveying path; and a controller, wherein the controller is configured to:

determine an image writing position by the exposure unit for a sheet in a main scanning direction which is perpendicular to a moving direction of the image carrier, based on a first detection result of the detector at a timing before a correction of a skew of the sheet by the skew corrector;

determine a shift amount of the pair of the rollers for the sheet, based on a second detection result by the detector at a timing after a correction of a skew of the sheet by the skew corrector; and control a shift operation of the pair of rollers to shift the sheet by the determined shift amount.

10. The image forming apparatus according to claim 9, wherein the detector is provided upstream of the pair of the rollers on the conveying path.

* * * * *